US007861571B1

(12) United States Patent
Giaimo

(10) Patent No.: US 7,861,571 B1
(45) Date of Patent: Jan. 4, 2011

(54) TRAPPED BALL DRAW PROCESS FOR REDUCING THE DIAMETER OF TUBING

(76) Inventor: Vincent Giaimo, 6070 SE. Grand Cay Ct., Stuart, FL (US) 34997-8282

( * ) Notice: Subject to any disclaimer, the term of this patent is extended or adjusted under 35 U.S.C. 154(b) by 65 days.

(21) Appl. No.: 12/268,414

(22) Filed: Nov. 10, 2008

(51) Int. Cl.
*B21D 3/00* (2006.01)
*B21D 17/04* (2006.01)
*B21C 37/30* (2006.01)
*B21C 1/24* (2006.01)

(52) U.S. Cl. ..... 72/367.1; 72/75; 72/283; 72/370.14; 72/370.25

(58) Field of Classification Search ..... 72/75, 72/77, 115, 117, 283, 284, 318, 367.1, 370.14, 72/370.25, 426
See application file for complete search history.

(56) References Cited

U.S. PATENT DOCUMENTS

| | | | | |
|---|---|---|---|---|
| 1,318,962 | A | 10/1919 | Brinkman | |
| 1,440,527 | A | 1/1923 | Brinkman | |
| 1,537,207 | A * | 5/1925 | Wikstrom | 72/75 |
| 2,124,961 | A | 7/1938 | Brinkman | |
| 2,155,437 | A * | 4/1939 | Moore et al. | 72/283 |
| 2,355,734 | A * | 8/1944 | Katz | 72/283 |
| 2,669,209 | A | 2/1954 | Hoffman | |
| 3,137,384 | A | 6/1964 | Perret | |
| 3,662,578 | A | 5/1972 | Gleason et al. | |
| 4,161,112 | A | 7/1979 | Stump | |
| 4,383,429 | A | 5/1983 | Ceccacci | |
| 4,745,787 | A | 5/1988 | Sansome et al. | |
| 4,947,669 | A | 8/1990 | Fuchs, Jr. | |
| 5,186,033 | A | 2/1993 | Nieczyporowicz | |
| 5,487,292 | A | 1/1996 | Fox | |
| 5,526,663 | A | 6/1996 | Sauvonnet et al. | |
| 5,881,592 | A | 3/1999 | Blackwell et al. | |
| 6,470,723 | B2 | 10/2002 | Sumitomo et al. | |
| 2006/0218985 | A1 | 10/2006 | Kenmochi et al. | |

FOREIGN PATENT DOCUMENTS

| | | |
|---|---|---|
| JP | 60-187425 | 9/1985 |
| JP | 61-286018 | 12/1986 |

* cited by examiner

*Primary Examiner*—Teresa M Bonk
(74) *Attorney, Agent, or Firm*—Swift Law Office; Stephen Christopher Swift

(57) ABSTRACT

A mechanical process to reduce and/or reform the mass of a tube (either metallic or of some other material) to specified dimensions, by any or all of the following means: thinning the wall of the tube, reducing the diameter of the tube, and elongation of the tube. The tube is operated on by a ball and a die having interior areas including: an initial entry with reduction angle, a wall reduction chamber, a final reduction angle, a land/bearing, and an exit relief ending in an area with a reverse taper. The tube has an outside diameter larger than the wall reduction chamber (in the raw material starting size) with a wall thickness somewhat larger than the gap between the outside diameter of the ball, and the inside diameter of the wall reduction chamber. The tube is pulled, pushed or drawn between the die and the ball, reducing its dimensions.

14 Claims, 4 Drawing Sheets

TRAPPED BALL DRAW PROCESS FOR REDUCING THE DIAMETER OF TUBING

BACKGROUND OF THE INVENTION

1. Field of the Invention

The present invention relates to processes for the forming, drawing and reduction of tubing.

2. Description of the Prior Art

There are previous inventions for the forming, drawing and reduction of tubing, but none that are equivalent to the present invention.

U.S. Pat. No. 1,318,962, issued on Oct. 14, 1919, to Louis H. Brinkman, discloses an apparatus for drawing metal using a ball die.

U.S. Pat. No. 1,440,527, issued on Jan. 2, 1923, to Louis H. Brinkman, discloses the use of dies wherein balls are provided for operating upon tubing. (See column 1, line 9-11.)

U.S. Pat. No. 2,124,961, issued on Jul. 26, 1938, to Louis H. Brinkman, discloses a metal drawing device, that may be used to reduce the diameter of tubing, with balls arranged in a circle around a mandrel. (See claim 1.)

U.S. Pat. No. 2,669,209, issued on Feb. 16, 1954, to Frederick C. Hoffman, discloses a die assembly for utilizing hydrostatic pressure in a deep body of water for forming sheets, using a ball in a check valve (83 in FIG. 7).

U.S. Pat. No. 3,137,384, issued on Jun. 16, 1964, to Marcel Perret, discloses hydraulic devices for removing tubes drawn on a long mandrel, including a spherical ball in the center of a die cavity (see column 5, lines 34-44). It also discloses a process of feeding the tube through the die and ball set (see column 6, lines 41-56). However, it appears that this is achieved through the use of an internal mandrel.

U.S. Pat. No. 3,662,578, issued on May 16, 1972, to Thomas E. Gleason and Charles C. Ripley, discloses turbulence promoter formation, in which a set of hardened balls in pressed against the surface of a tube to form grooves.

U.S. Pat. No. 4,161,112, issued on Jul. 17, 1979, to Paul E. Stump, discloses a tube drawing technique using a mandrel plug having compound working surfaces.

U.S. Pat. No. 4,383,429, issued on May 17, 1983, to Bruno Ceccacci, discloses an apparatus for forming a point at the end of a metal tube by means of a drawing operation.

U.S. Pat. No. 4,745,787, issued on May 24, 1988, to Dennis H. Sansome and Thiam B. Lim, discloses a plug assembly for use in the plug drawing of tubes.

U.S. Pat. No. 4,947,669, issued on Aug. 14, 1990, to Francis J. Fuchs, Jr., discloses a floating plug for drawing tubing materials (see FIG. 1, column 2, lines 1-31).

U.S. Pat. No. 5,186,033, issued on Feb. 16, 1993, to Alex Nieczyporowicz, discloses an apparatus and method for forming external raised beads on hollow tubing.

U.S. Pat. No. 5,526,663, issued on Jun. 18, 1996, to Jean-Louis Sauvonnet and Franck Delaquerie, discloses devices for the grooving of tubes.

U.S. Pat. No. 5,487,292, issued on Jan. 30, 1996, to Francis J. Fox, discloses tubing being reduced in diameter by the draw die system and the use of a floating plug or mandrel.

U.S. Pat. No. 5,881,592, issued on Mar. 16, 1999, to Ellis Blackwell and Darrell K. Maisel, discloses a floating plug for drawing tubing stock and reducing its diameter (see FIG. 1, column 2, lines 25-57).

U.S. Pat. No. 6,470,723, issued on Oct. 29, 2002, to Tetsuya Sumitomo, Koji Yamamoto and Toshiaki Hashizume, discloses an apparatus for manufacturing an internal grooved tube.

U.S. Patent Application Publication No. 2006/0218985, published on Oct. 5, 2006, to Kazuhito Kenmochi et al., discloses a method for manufacturing a tube with high dimensional accuracy.

Japanese Patent No. 60-187425, published on Sep. 24, 1985, inventor Tatsumi Aritaka, discloses a device that both reduces a metallic tube and forms grooves on the inside of the tube.

Japanese Patent No. 61-286018, published on Dec. 16, 1986, inventors Saeki Chikara, Sato Takuyuki and Iozaki Akio, discloses a device that both reduces a pipe and forms grooves on the inside of the pipe.

None of the above inventions and patents, taken either singly or in combination, is seen to describe the instant invention as claimed.

SUMMARY OF THE INVENTION

The present invention is a process that is a new and advanced technique for the reduction, forming or drawing of tubing, including metallic tubing, metallic alloy tubing, or tubing composed of any other material or materials. It can be applied to seamless tubing, welded tubing, extruded tubing, or any other type of tubing. This process differs from the floating plug draw method in that the size of the wall of the finished product is generated in the wall reduction chamber, rather than in the plug/die land area. The benefits of this process are: substantial production yield gained by increased material reductions, and the decrease of associated process problems (including plug upset, starting raw stock size limitations and lubrication issues). In the present invention, the ball is trapped in position between the wall of the raw stock behind the ball, and the finished tube wall which is positioned between the ball the final reduction angle, rather than by the clamp pressure of the material on the nose of the floating plug, as in the case of the floating plug method. This eliminates plug upset or slip back.

Accordingly, it is a principal object of the invention to increase tubing material reduction.

It is another object of the invention to eliminate plug upset or slip back.

It is a further object of the invention to decrease raw stock size limitations.

Still another object of the invention is to decrease lubrication issues.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a mechanical process to reduce and/or reform the mass of a tube (either metallic or of some other material) to specified dimensions, by any or all of the following means: thinning the wall of the tube, reducing the diameter of the tube, and elongation of the tube.

Figure 1:
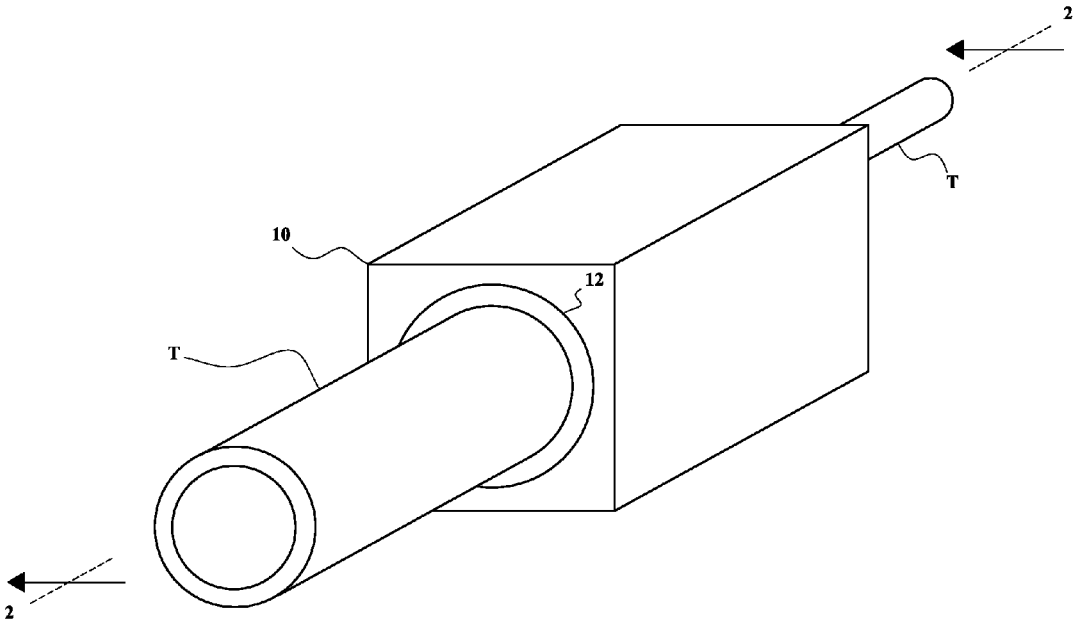
FIG. 1 is a perspective view of the preferred embodiment of the invention.

FIG. 1 is a perspective view of the preferred embodiment of the invention, showing the die 10, the tube T both before it is reduced (in front of the die) and after it is reduced (behind the die). Also shown is the initial entry with the reduction angle 12.

Figure 2:
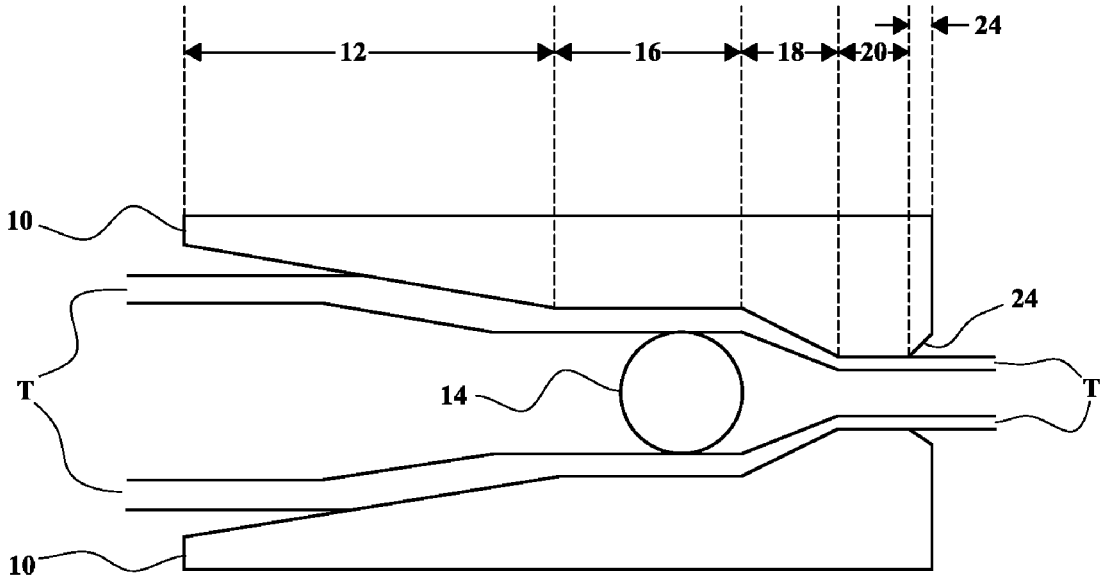
FIG. 2 is a sectional view of the preferred embodiment of the invention drawn along lines 2-2 of FIG. 1.

FIG. 2 is a sectional view of the preferred embodiment of the invention drawn along lines 2-2 of FIG. 1, showing the tube T, the ball 14, and the following segments of the interior of the die 10: the initial entry with reduction angle 12, the wall reduction chamber 16, the final reduction angle 18, the land/bearing 20, and the exit relief 24. The tube has an outside diameter larger than the wall reduction chamber (in the raw material starting size) with a wall thickness somewhat larger than the gap between the outside diameter of the ball, and the inside diameter of the wall reduction chamber. The tube is pulled, pushed or drawn between the die and the ball, reducing its dimensions. (The final product tube will typically become smaller in diameter and longer in length, with a thinner wall.) The ball is not retained in the tube by the use of any object other than the tube and the die.

Figure 3:
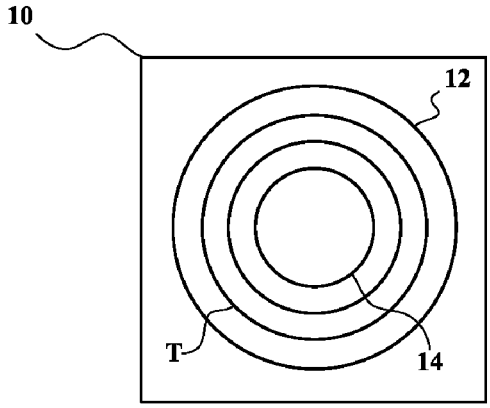
FIG. 3 is a front elevational view of the preferred embodiment of the invention.

FIG. 3 is a front elevational view of the preferred embodiment of the invention, showing the die 10, the initial entry 12, the tubing T (being reduced), and the ball 14.

Figure 4:
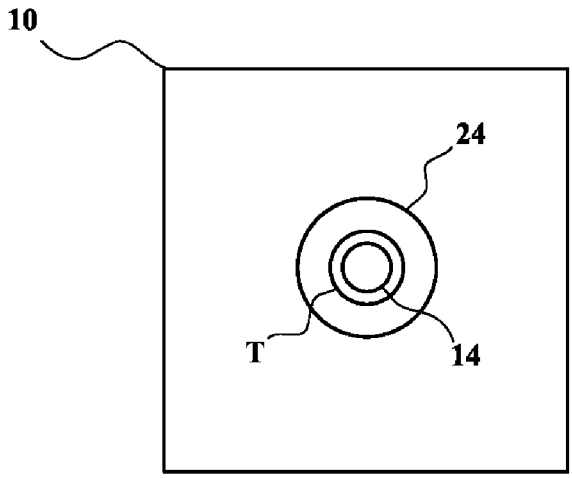
FIG. 4 is a rear elevational view of the preferred embodiment of the invention.

FIG. 4 is a rear elevational view of the preferred embodiment of the invention, showing the die 10, the area of reverse taper 24, the tubing T (after reduction), and the center part of the surface of the ball 14.

At the beginning of the process, a ball with a diameter somewhat smaller than the wall reduction chamber is selected and introduced into the tube, and both are drawn into the wall reduction chamber of the die. The ball is then trapped between the tube wall, the wall reduction chamber walls and the final reduction angle, thereby reducing the tube wall to the desired dimensions. (Alternatively, an interference point may be introduced at a location behind the starting point of the tube. The ball will then be inserted into the tube, and pushed back to the interference point. The tube will then be crimped or reduced, e.g., swagged or tagged, immediately forward of the ball. The tube and ball are then introduced into the die using any of the usual industry practices.) The sizes of the ball, the reduction chamber, and/or the exit diameter, can and will be varied to reach designated final product specifications (which will typically be mechanical and physical properties).

All external surfaces, dimensions and configurations will be specified to the process, for the purpose of holding or affixing the die to the various processing equipment used, but not limited to that end. The internal geometry of the die is all important to the draw process. The specifications are as follows (referring again to FIG. 2): a tapered cone or radius (initial reduction area 12) tapering down to a diameter, transitioning to a cylindrical chamber with parallel sides (wall reduction chamber area 16), transitioning to a taper (final reduction area 18), which tapers down to a diameter, transitioning to a cylindrical section with parallel sides (land/bearing 20) ending at a reverse taper (exit relief 24).

Initial Reduction Angle: The raw stock (unprocessed tube) contacts this area at the beginning of the reduction process. The outside diameter is reduced until contacting the transition to the wall reduction chamber. Angles used will be determined by raw material properties and final product specifications. Note that in some applications, a bell type radius may be used.

Wall Reduction Chamber: The wall of the raw stock (i.e., tube) is reduced to its final dimension in this area of the die. The diameter and length of this area will be determined by factors including, but not limited to, ball size, raw material size, and finished product specifications. After wall reduction is attained, the material will transition to the final reduction angle ("FRA").

Final Reduction Angle: This area is used as a ball check by holding the ball in its proper position. The tube wall interfaces between the FRA and the ball. The outside diameter of the material (i.e., tube) will be further reduced until reaching the exit diameter/land transition.

Exit Diameter: This dimension is slightly smaller than the diameter of the ball. It both prevents the ball from exiting the die, and generates the final outside diameter of the material (i.e., tube). The exit diameter is determined by either or both of the ball size and the final product specification.

Land Length: The length of this area will be determined by material properties, design parameters, and die life considerations, or any combination thereof.

Exit Relief: This area allows an interference free exit from the die. The angle of the reverse taper is determined by material properties and die strength factors. In some cases, the reverse taper of the exit relief may not be essential to the process.

Die Set: The die set consists of the forming die 10 and the round ball 14, or a cylinder with radius or tapered or chamfered ends or a combination thereof. The die set is preferably manufactured from tungsten carbide, for its wear/draw surface durability, but other suitable materials may be used. The dimensions and geometric parameters of the die set and it components are determined by the final product specifications, raw material properties, and equipment considerations.

Ball: The ball is preferably a plain spherical ball. Alternatively, it may be a cylinder with radius or one or more spherical ends, or one or more chamfered ends, or a combination thereof. In either case, it is preferably manufactured from tungsten carbide, for its wear/draw surface durability, but other suitable materials may be used. Size and finish are determined by the final product specifications.

It is to be understood that the present invention is not limited to the sole embodiment described above, but encompasses any and all embodiments within the scope of the following claims.

I claim:

1. A process that reduces an initial diameter of a tube, comprising the steps of:

placing a ball in the tube;

inserting an end of the tube into a first circular opening of a die, said die having a second circular opening of a smaller diameter than the first circular opening, and at least one chamber between the first and second circular opening with circular cross sections that decrease in diameter between the first and second circular opening, and wherein the diameters of the cross sections become less than the initial diameter of the tube and the diameter of the ball toward the second circular opening; and moving the tube through said chamber, creating pressure between a wall of the chamber and the ball that reduces the initial diameter of the tube;

wherein the ball is not retained in the tube by the use of any object other than the tube and the die;

wherein adjacent to the first circular opening in the die there is a first tapered chamber, the diameter of the first tapered chamber becomes less than the initial diameter of the tube;

wherein the first tapered chamber is immediately followed by a first cylindrical chamber also having a diameter less than the initial diameter of the tube, thus compressing a wall of the tube as the tube is moved through the die, but neither the first tapered chamber nor the first cylindrical chamber have a diameter less than the diameter of the ball; and wherein the first cylindrical chamber is immediately followed by a second tapered chamber, the diameter of the second tapered chamber becomes less than the diameter of the ball; and trapping the ball at a point where the first cylindrical chamber transitions to the second tapered chamber, and causing the ball to compress the wall of the tube.

2. The process that reduces the initial diameter of a tube according to claim 1, wherein:

between the second tapered chamber and the second opening in the die is a second cylindrical chamber, the second cylindrical chamber with a diameter that is less than both the diameter of the ball and the initial diameter of the tube.

3. The process that reduces the initial diameter of a tube according to claim 2, wherein:

adjacent to the second opening in the die is a section with a reverse taper, from which the tube exits with a reduced diameter.

4. The process that reduces the initial diameter of a tube according to claim 1, wherein:

the ball is spherical.

5. The process that reduces the initial diameter of a tube according to claim 1, wherein:

the tube is pulled through the die.

6. The process that reduces the initial diameter of a tube according to claim 1, wherein:

the tube is pushed through the die.

7. A process that reduces the thickness of the wall of a tube, comprising the steps of:

placing a ball in the tube;

inserting an end of the tube into a first circular opening of a die, said die having a second circular opening of a smaller diameter than the first circular opening, and at least one chamber between the first and second circular opening with circular cross sections that decrease in diameter between the first and second circular opening, and wherein the diameters of the cross sections become less than an initial diameter of the tube and the diameter of the ball toward the second circular opening; and moving the tube through said chamber, creating pressure between a wall of the chamber and the ball that reduces the thickness of the wall of the tube;

wherein the ball is not retained in the tube by the use of any object other than the tube and the die;

wherein adjacent to the first circular opening in the die there is a first tapered chamber, the diameter of the first tapered chamber becomes less than the initial diameter of the tube;

wherein the first tapered chamber is immediately followed by a first cylindrical chamber also having a diameter less than the initial diameter of the tube, thus compressing a wall of the tube as the tube is moved through the die, but neither the first tapered chamber nor the first cylindrical chamber have a diameter less than the diameter of the ball; and wherein the first cylindrical chamber is immediately followed by a second tapered chamber, the diameter of the second tapered chamber becomes less than the diameter of the ball;

trapping the ball at a point where the first cylindrical chamber transitions to the second tapered chamber, and causing the ball to compress the wall of the tube.

8. The process that reduces the thickness of the wall of a tube according to claim 7, wherein:

between the second tapered chamber and the second opening in the die is a second cylindrical chamber, the second cylindrical chamber with a diameter that is less than both the diameter of the ball and the initial diameter of the tube.

9. The process that reduces the thickness of the wall of a tube according to claim 8, wherein:

adjacent to the second opening in the die is a section with a reverse taper, from which the tube exits with walls of reduced thickness.

10. The process that reduces the thickness of the wall of a tube according to claim 7, wherein:

the ball is spherical.

11. A process that increases the length of a tube, comprising the steps of:

placing a ball in the tube;

inserting an end of the tube into a first circular opening of a die, said die having a second circular opening of a smaller diameter than the first circular opening, and at least one chamber between the first and second circular opening with circular cross sections that decrease in diameter between the first and second circular opening, and wherein the diameters of the cross sections become less than an initial diameter of the tube and the diameter of the ball toward the second opening; and moving the tube through said chamber, creating pressure between a wall of the chamber and the ball that increases the length of the tube;

wherein the ball is not retained in the tube by the use of any object other than the tube and the die;

wherein adjacent to the first circular opening in the die there is a first tapered chamber, the diameter of the first tapered chamber becomes less than the initial diameter of the tube;

wherein the first tapered chamber is immediately followed by a first cylindrical chamber also having a diameter less than the initial diameter of the tube, thus compressing a wall of the tube as the tube is moved through the die, but neither the first tapered chamber nor the first cylindrical chamber have a diameter less than the diameter of the ball; and wherein the first cylindrical chamber is immediately followed by a second tapered chamber, the diameter of the second tapered chamber becomes less than the diameter of the ball;

trapping the ball at a point where the first cylindrical chamber transitions to the second tapered chamber, and causing the ball to compress the wall of the tube.

12. The process that increases the length of a tube according to claim 11, wherein:

between the second tapered chamber and the second opening in the die is a second cylindrical chamber, the second cylindrical chamber with a diameter that is less than both the diameter of the ball and the initial diameter of the tube.

13. The process that increases the length of a tube according to claim 12, wherein:

adjacent to the second opening in the die is a section with a reverse taper, from which the tube exits with an increased length.

14. The process that increases the length of a tube according to claim 11, wherein:

the ball is spherical.

* * * * *